US005558615A

United States Patent [19]

Albert

[11] Patent Number: 5,558,615

[45] Date of Patent: Sep. 24, 1996

[54] MODULAR EXIT ROLLER ASSEMBLY

[75] Inventor: Kevin F. Albert, Barrington, N.H.

[73] Assignees: Heidelberger Druckmaschinen AG, Heidelberg, Germany; Heidelberg Harris Inc., Dover, N.H.

[21] Appl. No.: 297,729

[22] Filed: Aug. 29, 1994

[51] Int. Cl.[6] ..... B31B 1/00; B31F 1/00; B41F 13/56

[52] U.S. Cl. ..... 493/477; 493/478; 493/416; 493/357; 270/21.1; 270/41; 474/85

[58] Field of Search ..... 270/5, 6, 10, 13, 270/21.1, 41, 42, 43, 47; 493/477, 478, 357, 416, 436, 446; 474/84, 85, 86, 100; 271/274, 275; 198/626.4, 626.6

[56] References Cited

U.S. PATENT DOCUMENTS

| | | | |
|---|---|---|---|
| 655,355 | 8/1900 | Scott | 270/10 X |
| 3,894,479 | 7/1975 | Anikanov et al. . | |
| 4,382,594 | 5/1983 | Weigel et al. . | |
| 4,470,590 | 9/1984 | Ariga et al. . | |
| 4,537,390 | 8/1985 | Kiamco et al. . | |
| 4,720,089 | 1/1988 | Richter | 270/43 |
| 5,064,180 | 11/1991 | Wingate . | |
| 5,112,033 | 5/1992 | Breton | 270/47 |
| 5,405,127 | 4/1995 | Welborn | 270/21.1 |

FOREIGN PATENT DOCUMENTS

| | | |
|---|---|---|
| 2168686 | 6/1986 | United Kingdom . |

*Primary Examiner*—John E. Ryznic
*Attorney, Agent, or Firm*—Kenyon & Kenyon

[57] ABSTRACT

A folder apparatus is disclosed which has a removable mounting plate supporting both of the corresponding exit rollers of a single lead-in tape assembly. The modular cartridge formed by the mounting plate and exit rollers allows for easy replacement of these parts in the folder.

6 Claims, 2 Drawing Sheets

MODULAR EXIT ROLLER ASSEMBLY

FIELD OF THE INVENTION

The invention relates generally to printing presses and more particularly to the lead-in tape mechanism of a folder apparatus for a printing press for delivering signatures.

BACKGROUND OF THE INVENTION

Lead-in tape systems are commonly used to deliver signatures from a printing press to a stack. A lead-in tape system typically comprises a plurality of lead-in tape mechanisms spaced apart from one another and located side-by-side to one another to contact the signature across its width. Each lead in-tape mechanism has a lead-in tape on one side and a corresponding counter-rotating lead-in tape on the other side to form a signature passage, so that the signature is grasped on both sides and may be transported through the signature passage. Often the signature leaves the signature passage and enters a fan or fans which receive the signature in a fan pocket. The signature is then delivered to a stack as the fans rotate, as described in U.S. Pat. No. 5,112,033, herewith incorporated by reference.

The lead-in tapes typically have guide rollers and a drive roller located inside the lead-in tape for guiding and driving the tape. There are guide rollers at the bottom of the lead-in tape where the signature exits, i.e. the exit rollers.

One exit roller is typically fixed and the other exit roller spring-loaded in the direction of the fixed roller to maintain a positive squeeze on the signature as it enters the fans. This squeeze is necessary to assist in driving the signatures into the fans to help receive the signatures. As the signatures pass through the exit rollers, there is a head-to-tail space between the individual signatures, or books. When the spring-loaded exit rollers encounter this gap in the signattires, they close on the fixed rollers and reopen when the head of the next signature is encountered. This creates a bounce phenomena which causes high dynamic loads on the-fixed rollers.

Premature and repeated failure of the bearings, tapes or other components may then occur, as well as fretting corrosion of the loaded components and slippage of exit roller levers which hold the exit roller.

Replacement of these components has proved difficult, time-consuming, and inefficient since the press must be stopped and the lead-in tape mechanism accessed. Initial setting and alignment of the replaced components —important for proper signature delivery —is also time-consuming and difficult inside the close confines of the folder.

SUMMARY OF THE INVENTION

An object of the present invention is to provide an easy method for replacement of the exit rollers of a lead-in tape mechanism.

Another object of the invention is to allow for initial setting and alignment of the exit rollers of a lead-in tape mechanism to take place outside of the folder.

The present invention therefore provides a folder apparatus comprising a frame; a mounting plate removably mounted on the frame; a first exit roller of a lead-in tape mechanism; and a corresponding second exit roller; the first exit roller and the second exit roller mounted to the mounting plate, so that the first exit roller, second exit roller and mounting plate form a modular cartridge. The modular cartridge therefore comprises a mounting plate removable from a frame component of a folder; a first exit roller of a lead-in tape mechanism; and a corresponding second exit roller; the first exit roller and the second exit roller mounted to the mounting plate.

This arrangement allows for easy replacement of the exit rollers of a lead-in tape mechanism, since the corresponding exit rollers are mounted to the mounting plate to form a modular cartridge and the entire assembly can be replaced by untightening and tightening bolts on the mounting plate.

Initial setting and alignment of the exit rollers is also much simpler, since the relationship of the exit rollers can be adjusted on the mounting plate outside the folder and maintained during installation in the folder. This also allows for pre-assembly of a modular exit roller cartridge which can then be installed in the event of part failure to minimize press downtime.

BRIEF DESCRIPTION OF THE DRAWINGS

The present invention will be described in greater detail with respect to the drawings below.

DETAILED DESCRIPTION

Figure 1:
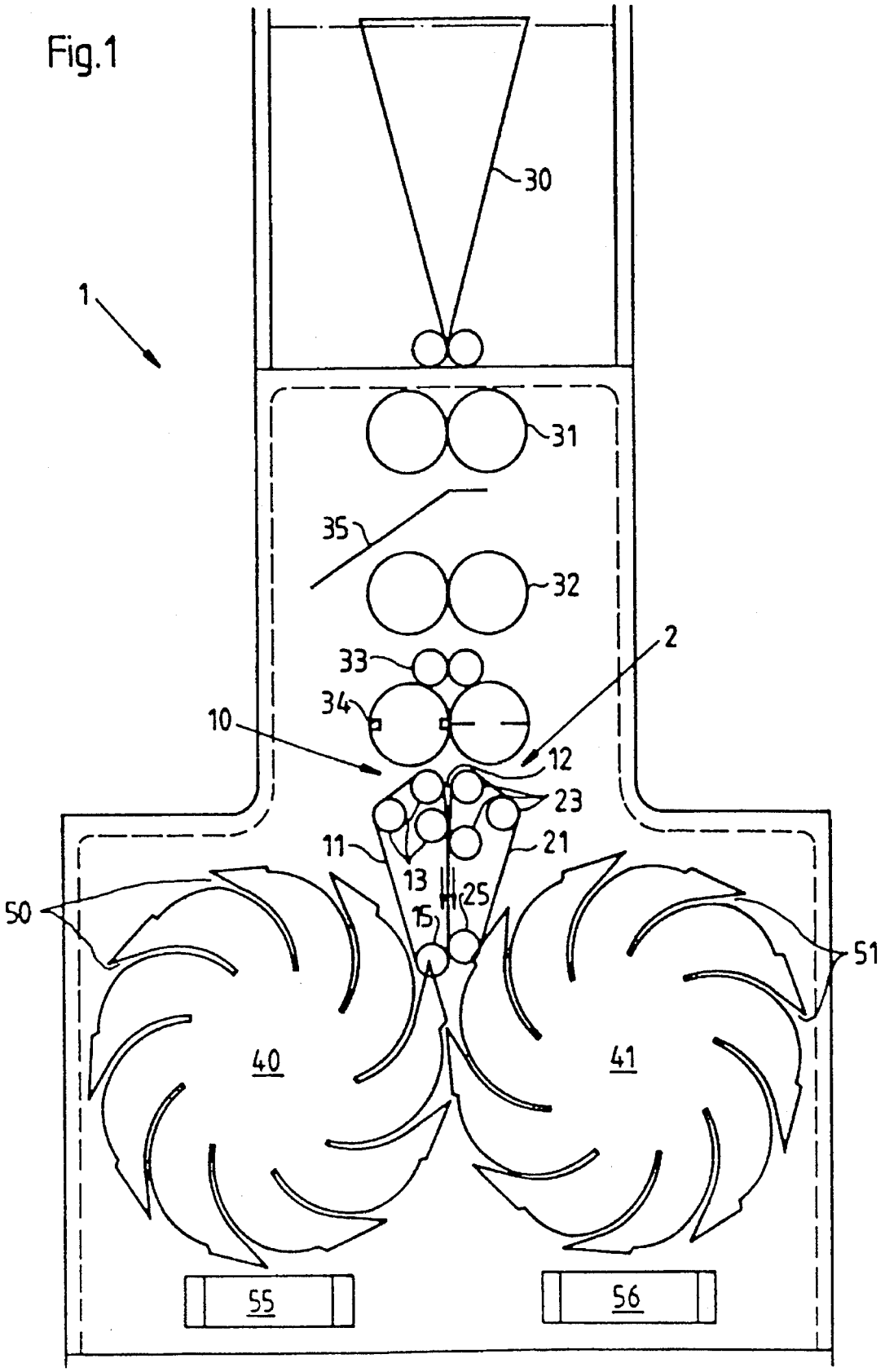
FIG. 1 shows a side-view of a typical folder apparatus for a web-fed printing press.

FIG. 1 shows a typical folder apparatus I for a web-fed printing press. The printed webs are conducted over a former 30 and folded. After being folded, the web is fed through the nips of upper and lower draw rollers 31 and 32, respectively, and guide rollers 33 to a cutting cylinder 34, which severs the web to form printed signatures. A web separating device 35 is provided between the upper draw rollers 31 and the lower draw rollers 32.

The signatures are then fed by a lead-in tape system 2 to fan pockets 50 and 51 of fans 40 and 41, respectively. As the fans 40 and 41 rotate, the signatures are deposited to stacks 55 and 56, respectively. The lead-in tape system 2 has at least one lead-in-tape mechanism, and preferably more than one side-by-side and parallel lead-tape mechanisms with coaxial exit rollers, including a first lead-in tape mechanism 10, for grasping the signatures across its width.

The first lead-in tape mechanism 10 has a left lead-in tape 11 and a corresponding right lead-in tape 21, foraging a signature passage 12. The lead-in tape mechanism 10 also has left upper rollers 13 and fight upper rollers 23, which can comprise guide or drive rollers for guiding and driving the left and right lead-in tapes 11 and 21, respectively. The lead in-tape mechanism 10 also has left exit roller 15 and corresponding right exit roller 25.

Figure 2:
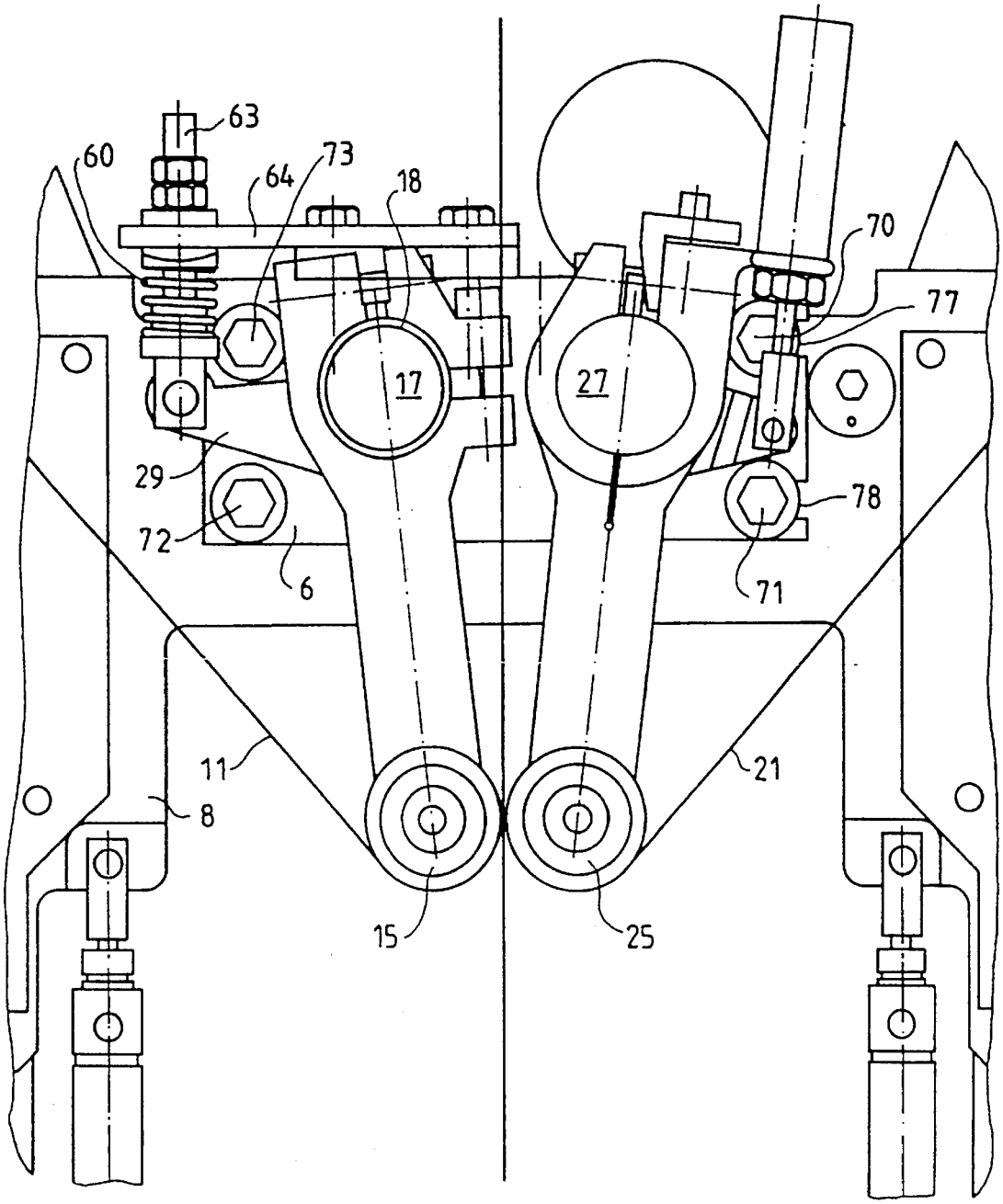
FIG. 2 shows a side view of a modular cartridge and folder according to the present invention.

As shown in FIG. 2, the lead-in tape mechanism 10, one of preferably a plurality of side-by-side lead in tape mechanisms, has left lead-in tape 11 and corresponding right lead-in tape 21. The left exit roller 15 is mounted at one end of a left lever 16, which is fixedly mounted at the other end to a sleeve 18. Sleeve 18 can rotate around a stud 17, which is attached to mounting plate 6, to allow the left lever and left exit roller to be spring-loaded against right exit roller 25. On the right side, right exit roller 25 is rotatably mounted on one end of a right lever 26, which is fixedly mounted at the other end to a fixed stud 27. Fixed stud 27 is fixedly mounted to the mounting plate 6, so that the right exit roller 25 can rotate but is translationally fixed during operation.

An arm 29 is also fixed by a clamp bolt to the sleeve 18, the arm having a top side and a bottom side. A coil spring 60 is located around a preload bolt 63 held by one end of a bolt support 64, the coil spring 60 operating between the support 64 and the top side of the arm 29. The bolt support 64 is mounted at the other end to top of the mounting plate 6.

The mounting plate 6 therefore supports all of the components supporting the corresponding exit rollers 15 and 25, which together form a modular roller cartridge. The mounting plate in turn is mounted to a frame component 8 by four bolts 70, 71, 72, 73. To remove the exit rollers and mounting plate the two left bolts 72 and 73 are fully removed, the two right bolts 70, 71 loosened, and the mounting plate 6 is slid out to the left. As shown, the mounting plate has two notches 77 and 78 on its right side which allow for this movement. During installation of a new cartridge, the two notches 77 and 78 also provide support for the right side of the mounting plate 6 while the left bolts 72, 73 are fastened. Once the cartridge is removed, any defective parts can be easily replaced, and the position of the exit rollers 15, 25 pre-adjusted before the roller cartridge is reinserted in the same or a similar folder.

While the present invention has been detailed in the embodiment described above, it is also contemplated the invention may encompass further embodiments than those described, and particularly that different types of mechanisms could be used to fasten the mounting plate to the frame component, while still permitting removal of the mounting plate.

What is claimed is:

1. A modular cartridge comprising:

a mounting plate removable from a frame component of a folder, mounting plate having two notches on one side for receiving two bolts;

a lead-in tape mechanism having a first exit roller and a corresponding second exit roller, wherein the first exit roller and the second exit roller are mounted to the mounting plate.

2. The modular cartridge as recited in claim 1 further comprising a first lever and a second lever, the first lever supporting the first exit roller and the second lever supporting the second exit roller.

3. The modular cartridge as recited in claim 7 further comprising a first stud and a second stud, the first stud connected to the mounting plate and supporting the first lever and the second stud connected to the mounting plate and supporting the second lever.

4. A folder comprising:

a frame;

a mounting plate removably mounted on the frame, the mounting plate having two notches on one side for receiving two bolts;

a plurality of bolts for fastening the mounting plate to the frame, a lead-in tape mechanism having a first exit roller and a corresponding second exit roller;

the first exit roller and the second exit roller mounted to the mounting plate, so that the first exit roller, second exit roller and mounting plate form a modular cartridge.

5. The folder as recited in claim 4 further comprising a first lever and second lever, the first liver supporting the first exit roller and the second lever supporting the second exit roller.

6. The folder as recited in claim 5 further comprising a first stud and a second stud, the first stud connected to the mountion plate and supporting the first lever and the second stud connected to the mounting plate and supportion the second lever.

* * * * *